US007247991B2

(12) United States Patent
Chen et al.

(10) Patent No.: US 7,247,991 B2
(45) Date of Patent: Jul. 24, 2007

(54) DIMMING BALLAST AND METHOD

(75) Inventors: Timothy Chen, Aurora, OH (US); Didier Rouaud, Roanoke, VA (US); James K. Skully, Wllloughby, OH (US)

(73) Assignee: General Electric Company, Schenectady, NY (US)

( * ) Notice: Subject to any disclaimer, the term of this patent is extended or adjusted under 35 U.S.C. 154(b) by 29 days.

(21) Appl. No.: 11/300,841

(22) Filed: Dec. 15, 2005

(65) Prior Publication Data

US 2007/0138967 A1 Jun. 21, 2007

(51) Int. Cl.
*H05B 39/04* (2006.01)

(52) U.S. Cl. ..... 315/106; 315/219; 315/291; 315/209 R; 315/244; 315/276; 315/DIG. 4; 315/DIG. 7

(58) Field of Classification Search ..... 315/105–107, 315/219, 225, 244, 247, 209 R, 291, 276, 315/278, 308, 360, DIG. 4, DIG. 5, DIG. 7
See application file for complete search history.

(56) References Cited

U.S. PATENT DOCUMENTS

| | | | | |
|---|---|---|---|---|
| 4,219,760 | A | 8/1980 | Ferro | |
| 4,399,391 | A * | 8/1983 | Hammer et al. | 315/244 |
| 4,663,570 | A | 5/1987 | Luchaco et al. | |
| 4,998,046 | A | 3/1991 | Lester | |
| 5,173,643 | A * | 12/1992 | Sullivan et al. | 315/276 |
| 5,519,289 | A * | 5/1996 | Katyl et al. | 315/224 |
| 5,877,592 | A | 3/1999 | Hesterman et al. | |
| 5,959,408 | A * | 9/1999 | Steel et al. | 315/106 |
| 6,218,788 | B1 | 4/2001 | Chen et al. | |
| 6,603,274 | B2 * | 8/2003 | Ribarich et al. | 315/291 |
| 2006/0103317 | A1 * | 5/2006 | Chen et al. | 315/98 |

* cited by examiner

*Primary Examiner*—Haissa Philogene
(74) *Attorney, Agent, or Firm*—Fay Sharpe LLP

(57) ABSTRACT

A ballast lamp circuit and method of operation is disclosed. The ballast lamp circuit comprising an inverter circuit and cathode heating circuit, wherein a lamp current, generated by the inverter circuit, is inversely proportional to a lamp cathode voltage generated by the cathode heating circuit.

29 Claims, 5 Drawing Sheets

DIMMING BALLAST AND METHOD

BACKGROUND OF THE INVENTION

Traditionally, dimming of hot cathode fluorescent lamps is accomplished by controlling the operating frequency of a series resonant inverter that drives all the lamps in series. A closed loop control circuit regulates the lamp current or power to adjust the lumen output of the lamp to provide dimming.

In order to provide a satisfactory life of the lamp, a cathode voltage is provided to the lamp cathodes with increasing value as the lamp is dimmed. This applied cathode voltage has the effect of heating the cathode in such a way as to reduce the sputtering effect of the lamp at lower operating currents when operated in a dimmed mode. The cathode voltage continuously supplies the cathode heating, although at an increased voltage, as the lamp is dimmed.

The dimming system and method described heretofore has some disadvantages. First, a series lamp configuration results in an increase in maintenance costs relative to a parallel lamp configuration. All lamps in a series configuration will fail if one lamp fails. This failure mode necessitates service calls every time one lamp fails. Secondly, a continuously supplied voltage to the cathodes, even when the lamp is providing 100% lumen output, is an inefficient technique for dimming. The cathodes dissipate up to 3 watts or 10% of the system power for each lamp without producing any visible light.

This disclosure provides a ballast circuit and method of dimming lamps that overcomes some of the disadvantages associated with a continuously supplied cathode voltage lighting system. In addition, this disclosure also demonstrates a method for parallel lamp dimming.

BRIEF DESCRIPTION OF THE INVENTION

A ballast lamp circuit comprising an inverter circuit configured to convert a dc waveform to a first ac current waveform for driving a first lamp; and a cathode heating circuit operatively connected to the inverter circuit and configured to generate a second ac waveform for heating the electrodes of the first lamp, the RMS value of the second ac waveform decreasing as the RMS value of the first ac current waveform increases, and the RMS value of the second ac waveform increasing as the RMS value of the first ac current waveform decreases, wherein the RMS value of the first and second ac waveform are controlled with pulse width modulation.

A method of operating a hot cathode lamp, comprising driving one or more lamps with a lamp current to produce a lamp lumen output, the lamp lumen output decreasing as the lamp current RMS value is decreased and increasing as the lamp current is increased by the control of the lamp current via pulse width modulation; and supplying a pulse width modulated cathode heating voltage that is synchronized with the lamp's current to the electrodes of the one or more lamps, the cathode heating voltage decreasing as the lamp current is increased and increasing as the lamp current is increased, the cathode heating voltage limited to a minimum voltage when the lamp current is less than a predetermined value and the cathode heating voltage is at a minimum or zero when the lamp current is more than a predetermined value.

DETAILED DESCRIPTION OF THE INVENTION

Figure 1:
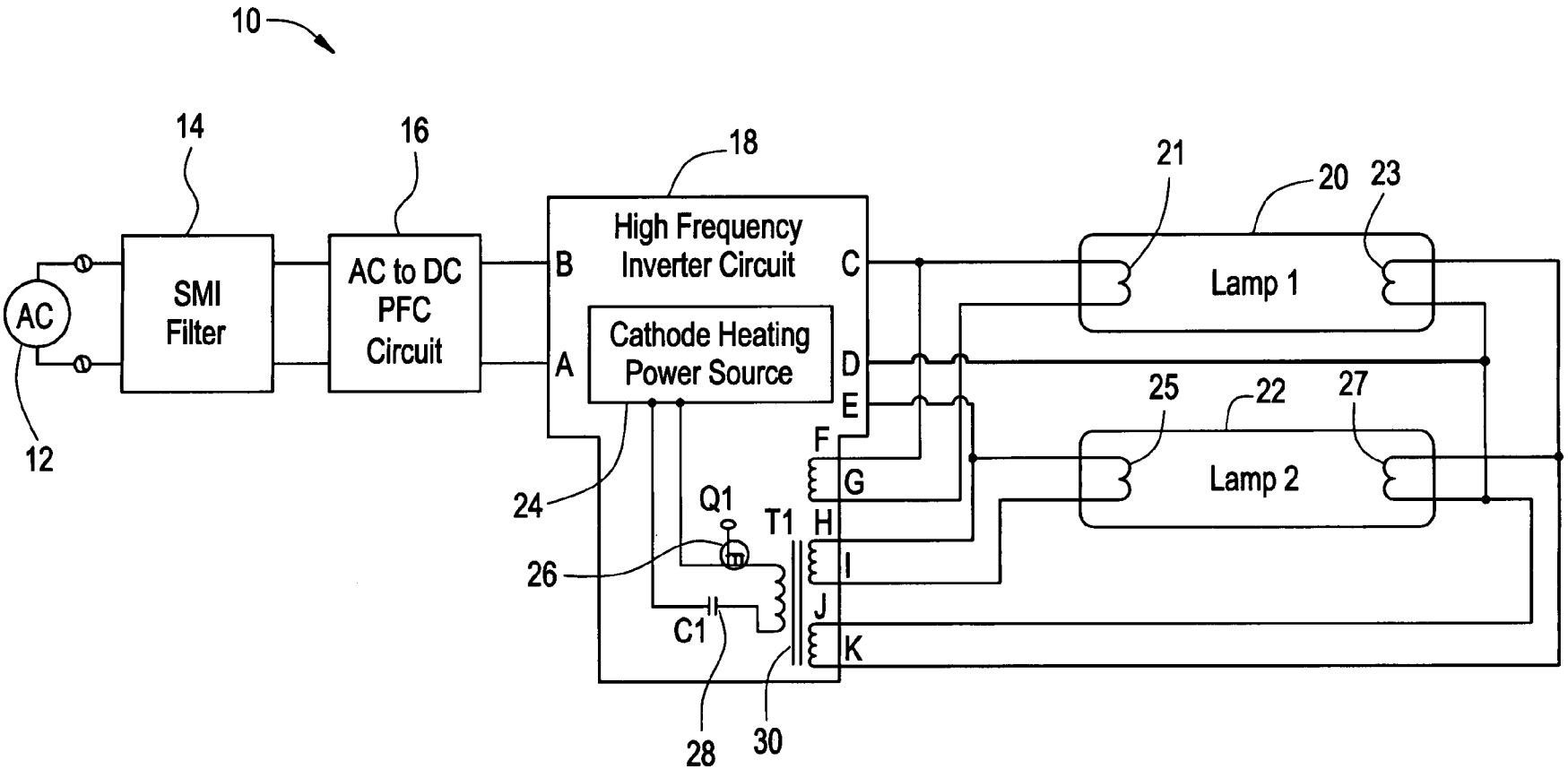
FIG. 1 is a schematic representation of an exemplary embodiment of this disclosure.

With reference to FIG. 1, illustrated is a ballast lamp circuit 10 block diagram according to one embodiment of this disclosure. As will be described in further detail below, this ballast lamp circuit 10 enables Lamp 1 20 and Lamp 2 22 to operate in a series or parallel configuration. However, it is to be understood that this embodiment and disclosure is not limited to a two lamp system. The dimming ballast and method disclosed can drive three, four, five, six, seven, or more lamps provided the necessary power is available and the ballasts are configured appropriately.

A voltage supply 12 provides an AC line voltage to the ballast lamp circuit 10. The voltage supply 12 can include a wide range of voltages depending on the line voltages available. For example, 120V and 277V are typically available in the U.S., however, other line voltages can be utilized to supply the ballast circuit.

The ballast circuit 10 includes an EMI filter 14, an AC to DC PFC circuit 16, and a High Frequency Inverter circuit 18. The High Frequency Inverter circuit 18 includes a Cathode Heating power source 24, a Cathode Heating switching transistor Q1 26, switching capacitor C1 28 and transformer T1 30. This ballast circuit 10 is utilized to drive Lamp 1 20 and Lamp 2 22, however, additional lamps can be added to this circuit. Moreover, the ballast circuit 10 illustrated in FIG. 1 will operate a single lamp.

The operation of the ballast circuit is now described. As previously discussed, an AC line voltage 12 provides power to the ballast circuit. The AC line voltage 12 is initially filtered by an EMI filter 14, and subsequently fed to an AC to DC PFC circuit 16. The AC to DC PFC circuit 16 converts the filtered AC line voltage to a DC voltage. This DC voltage is fed to a High Frequency Inverter circuit 18 to be inverted to a high frequency ac waveform for driving lamps 20 and 22, and an ac waveform to heat cathodes 21, 23, 25 and 27 of the lamps when dimming.

Operation of the High Frequency Inverter circuit 18 to drive Lamps 1 20 and 2 22 will now be described with reference to a bi-level lumen output. However, the ballast circuit illustrated in FIG. 1 will provide multiple levels of lamp dimming and/or a gradual dimming operation which dims Lamps 1 20 and 2 22 in a gradual fashion until the desired lumen output is achieved by the duty ratio of the pulse width modulated signal.

Figure 2A:
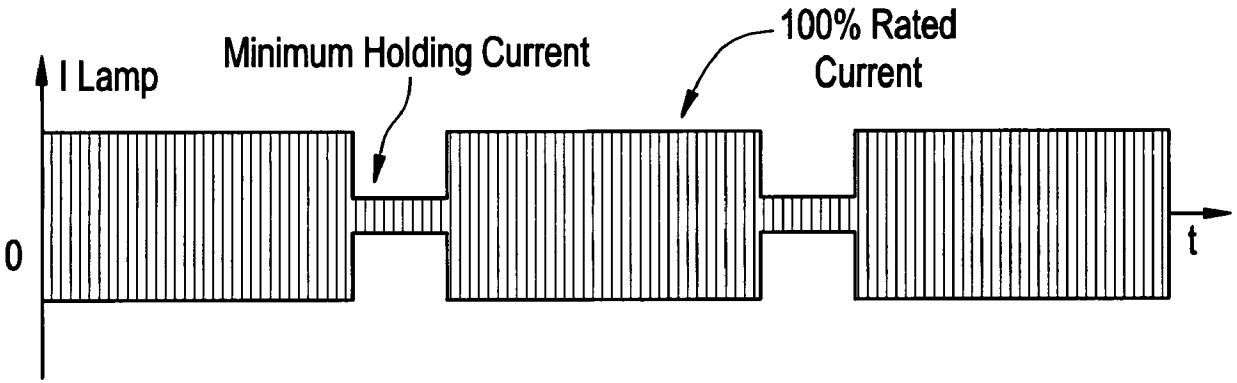
FIG. 2A and FIG. 2B illustrate the lamp current and cathode voltage of a lamp, respectively, according to an exemplary embodiment of this disclosure.
Figure 2B:
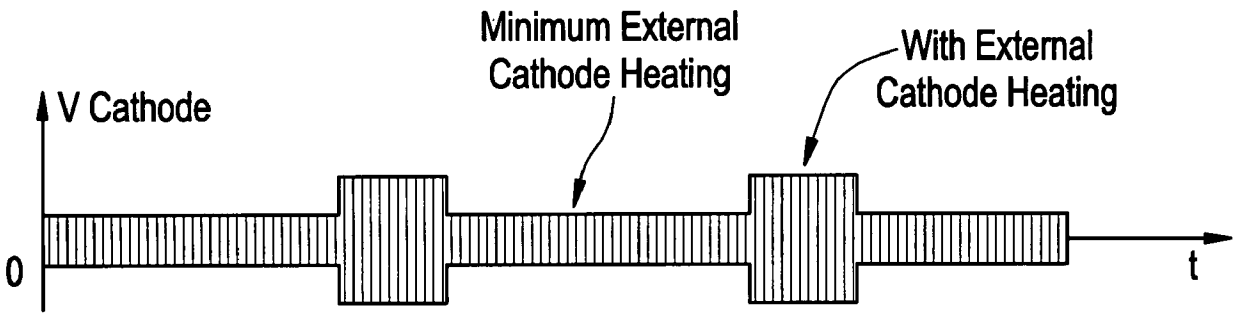

With reference to FIG. 2A and FIG. 2B, illustrated are waveforms of the lamp current, I lamp, and cathode heating voltage, V cathode, as a function of time. The lamp current, I lamp, is provided to Lamp 1 20 at terminals C and D of the High Frequency Inverter circuit 18. Terminal D is the return path for the I lamp current if the High Frequency Inverter circuit 18 is configured to drive lamps in parallel. Terminal C and terminal E provide lamp current I lamp to Lamp 1 and Lamp 2, respectively. To drive Lamp 1 and Lamp 2 in a series configuration, terminal E is configured to provide an open circuit and terminal D provides the lamp current return path.

With further reference to FIG. 2B, the waveform of V cathode is provided to the cathodes of Lamp 1 22 and Lamp 2 22 at terminals F, G, H, I, J and K of the Cathode Heating circuit. Specifically, the secondary windings of transformer T1 30, terminals F and G, are connected to a first cathode 21 of Lamp 1. Terminals H and I of transformer T1 30 are connected to a first cathode 25 of Lamp 2. Terminals J and K of transformer T1 30 provide voltage to a second cathodes 23 and 27 of Lamp 1 and Lamp 2, respectively.

Transistor Q1 26 provides the control to produce the V cathode waveforms of FIG. 2B. Specifically, by switching Q1 26 to the conducting state, transformer T1 30 is energized and a voltage is produced at the cathodes of Lamp 1 20 and Lamp 2 22. The switching of Q1 26 can be controlled by an external device, such as a dimmer switch, etc., operatively controlling a logic device to control the switching rate of transistor Q1 26 to provide the necessary RMS value of V cathode to be applied to cathodes 21, 23, 25 and 27 of Lamp 1 and Lamp 2. The necessary RMS value of V cathode will be dependent on the desired lumen output of Lamp 1 20 and Lamp 2 22. More specifically, the higher the lamp lumens, the higher the lamp current, I lamp, necessary to drive the lamps. This relatively high lamp current negates the need for a lamp cathode voltage to reduce sputtering. As illustrated in FIG. 2, V cathode is equal to zero or at a minimum when I lamp is equal to the 100% rated current of the lamp.

During a dimmed lamp mode of operation, the switching of Q1 26 is controlled to provide a voltage at cathodes 21, 23, 25 and 27 of Lamp 1 and Lamp 2 to maintain proper heating of the cathodes while I lamp is at the minimum of the lamp rated current. The proper heating of the cathodes is the amount of heating, i.e. V cathode RMS, necessary to maintain an acceptable cathode temperature to minimize sputtering.

The technique described heretofore to control the RMS value of the voltage applied to the cathodes of Lamp 1 20 and Lamp 2 22 is synchronized with the pulse width modulation (PWM) dimming of the lamp's current. In general, the lower the Lamp lumen output, the higher the duty ratio of pulse width modulated voltage generated and applied to the Lamp cathodes. In contrast, the higher the lamp current, the lower the duty ratio of the pulse width modulated voltage generated and applied to the lamp cathodes.

Stated another way, as the pulse width of the positive cathode voltage increases, the RMS voltage across the cathode increases, thereby providing a relative increase in energy to heat the cathode. Conversely, as the pulse width of the positive cathode voltage decreases, the RMS voltage across the cathode decreases, thereby providing a relative decrease in energy to heat the cathode. As the lamp(s) reach their maximum rated power, the cathode heating voltage approaches a minimum or zero RMS volts depending on the type of lamp and inverter circuit used.

It should be noted the vertical bars illustrated in FIG. 2A represent the High Frequency Inverter frequency and the envelope of vertical bars illustrated in FIG. 2B represent the frequency of the PWM control signal operatively connected to the input of Q1 which is generally in the range of 100 hz to 600 hz to minimize the flicking effect observed by human eye.

As substantially described above, this disclosure describes a ballast lamp circuit comprising an inverter circuit and a cathode heating circuit operatively connected to the inverter circuit. The inverter circuit and cathode heating circuit are operatively connected to one or more lamps to provide multiple lumen output levels, i.e. dimming, while maintaining a minimum cathode temperature for reducing sputtering of the one or more lamps.

Variations of the ballast lamp circuit 10 illustrated in FIG. 1 and FIG. 2, and previously described with reference to these figures, include a ballast lamp circuit wherein the minimum RMS value of the cathode voltage is a predetermined value, the cathode heating circuit generating the minimum RMS value voltage when the lamp current is greater than another predetermined value. For example, a minimum cathode voltage of approximately 0.4 V RMS for a Lamp current greater than or equal to approximately 75% of the related lamp current.

Other variations include the High Frequency Inverter circuit comprising two or more inverter and cathode heating circuits as described, wherein multiple lamps are driven and dimmed to produce a multitude of dimming modes.

With regard to controlling the substantially inverse relationship between the lamp(s) current and cathode voltage, multiple configurations of the ballast lamp circuit described heretofore are available. In general, these configurations control the lamp current circuit and cathode heating voltage circuit to generate a cathode heating ac voltage with an RMS value which decreases as the RMS value of the ac lamp current increases. In addition to this inverse relationship between the lamp current and cathode heating voltage, predetermined limits can be implemented via programming of the controller or hardware implementation to provide a minimum cathode heating voltage and/or a maximum cathode heating voltage.

As previously discussed, the cathode voltage RMS value is controlled via PWM. For example, a relatively low frequency oscillator voltage, i.e. 100 Hz to 1 kH, is generated by the cathode heating circuit and this oscillator voltage is pulse width modulated to provide the appropriate RMS voltage to the cathodes of the lamps. As the lamp current is increased, the cathode voltage is decreased by reducing the pulse width of the cathode heating circuit oscillator voltage. The opposite scenario takes place for a decrease in lamp current. Specifically, the lamps are dimmed, the RMS value of the cathode voltage is increased by increasing the width of the pulse width modulated cathode voltage waveform.

Embodiments of this disclosure comprise a synchronous or nonsynchronous operation with regard to the control of the cathode voltage as related to the lamp current. For synchronous operation, one embodiment, as illustrated in FIG. 1, comprises a switching transistor Q1. The circuitry of the High Frequency Inverter circuit is operatively connected to transistor Q1 such that a low lamp current produces a synchronized, corresponding in transistor Q1 "on" to generate increase of cathode voltage. Moreover, the High Frequency Inverter circuit is operatively connected to transistor Q1 such that an increase in lamp current produces a synchronized, corresponding in transistor Q1 "off" to generate a decrease of cathode voltage.

A nonsynchronous relationship between the lamp current and cathode voltage, as described above, is also within the scope of this disclosure. For example, where the lamp current and cathode voltage are independently controlled.

Examples of other variations for PWM control comprise a PWM voltage RMS related to a frequency modulated lamp current and a PWM voltage RMS related to an amplitude modulated lamp current.

Figure 3:
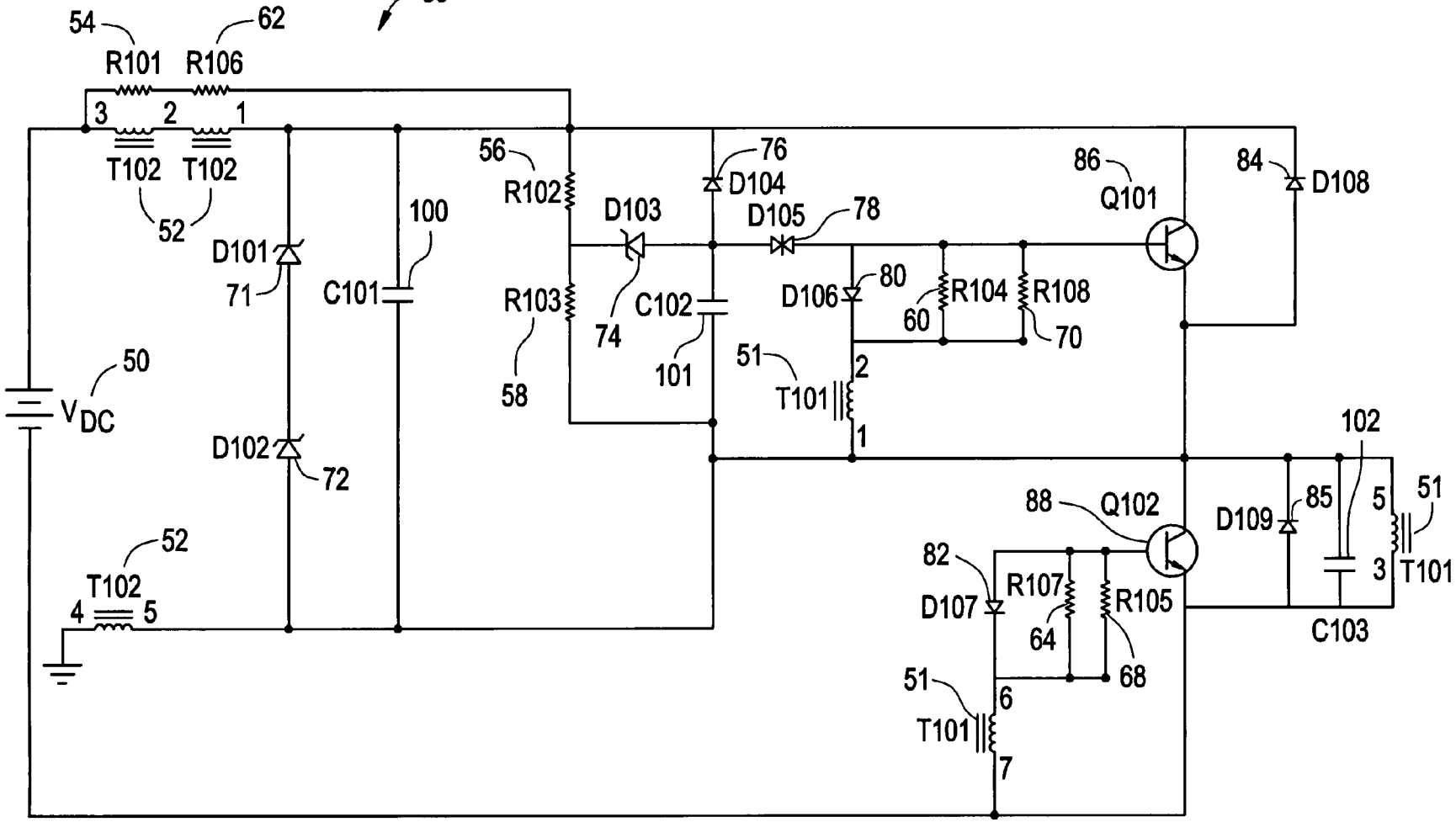
FIG. 3 is a schematic representation of a current fed inverter according to an exemplary embodiment of this disclosure.
Figure 4:
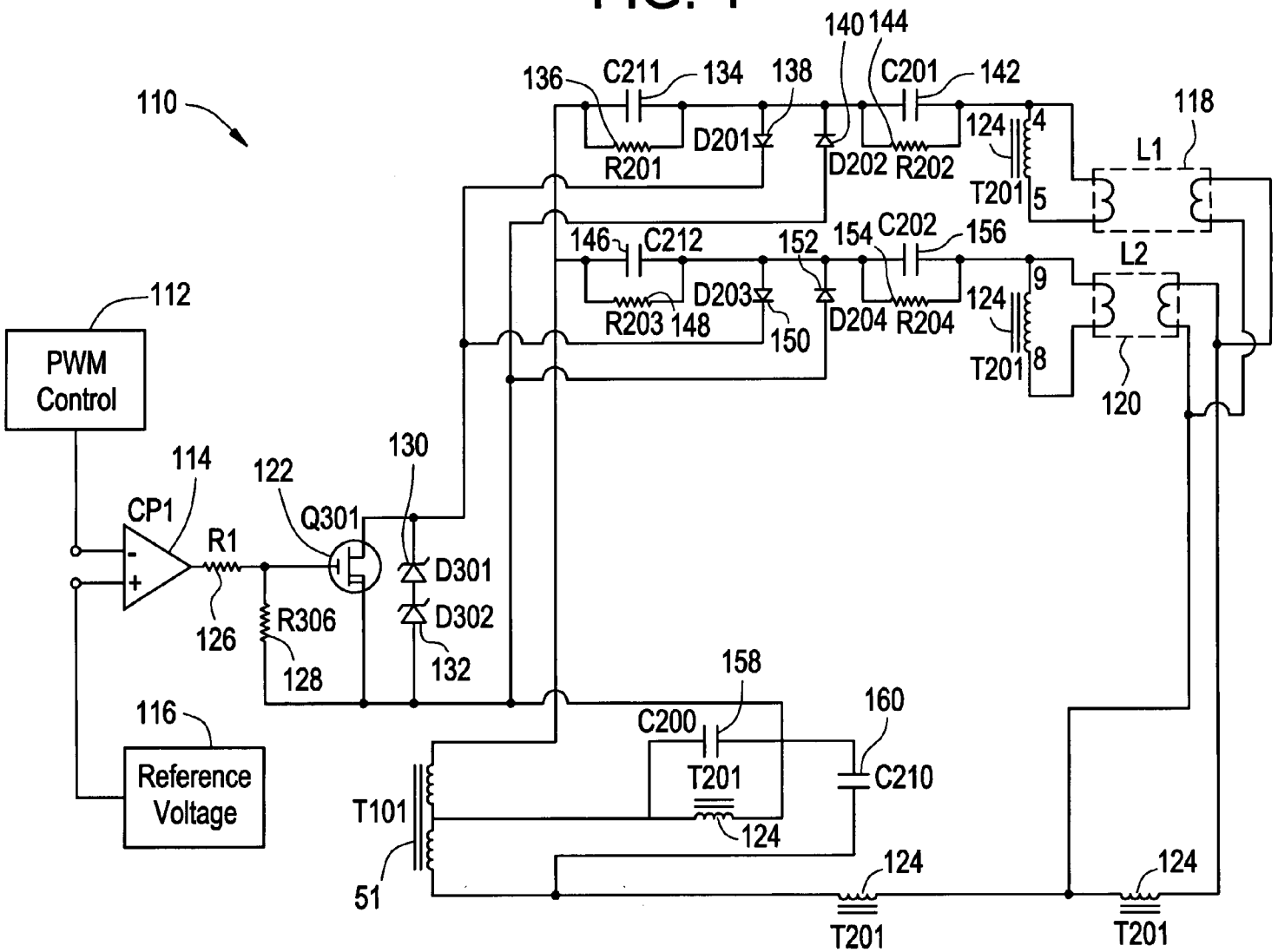
FIG. 4 is a schematic representation of a parallel lamp ballast circuit according to an exemplary embodiment of this disclosure.

With reference to FIGS. 3 and 4, illustrated is a schematic representation of a High Frequency Inverter circuit 18 comprising a Cathode Heating power source 24 according to one embodiment of this disclosure. FIG. 3 schematically illustrates the inverter portion 50 which provides the necessary power to drive one or more lamps. This circuit is described in a co-pending U.S. patent application by Timothy Chen et al., application Ser. No. 10/987,472, commonly owned and assigned to General Electric Company and hereby totally incorporated by reference in its entirety.

In one embodiment of this disclosure,

| | |
|---|---|
| $V_{DC}$ (50) = 450Vrms | D102 (72) = TVS 440V |
| R101 (54) = 330 kohm | D103 (74) = SUM1M 47L |
| R102 (56) = 330 kohm | D104 (76) = SUM1M 47L |
| R103 (58) = 620K Ohm | D105 (78) = 32V Diac |
| R104 (60) = 620K Ohm | D106 (80) = 1N5817 |
| R105 (68) = 150 Ohm | D107 (82) = 1N5817 |
| R107 (64) = 150 Ohm | D108 (84) = US1M |
| R108 (70) = 150 Ohm | D109 (85) = US1M |
| C101 (100) = 1.5 nf | T101 (51) = 0.78 mH |
| C102 (101) = 0.22 uf | T102 (52) = 2.5 mH |
| C103 (102) = 3.9 nf | Q101 (124) = BUL1101E |
| D101 (71) = TVS 440V | Q102 (88) = BUL1101E |

With reference to FIG. 4, illustrated is a schematic representation of a parallel lamp circuit 110 according to one embodiment of this disclosure. This circuit is operatively connected to the inverter circuit illustrated in FIG. 3 via T101 51.

In one embodiment,

| | |
|---|---|
| R1 (126) = 100 Ohm | D201 (138) = SR1M |
| R201 (136) = 1M Ohm | D202 (140) = SR1M |
| R202 (144) = 1M Ohm | D203 (150) = SR1M |
| R203 (148) = 1M Ohm | D204 (152) = SR1M |
| R204 (154) = 1M Ohm | D301 (130) = TVS 440V |
| R306 (128) = 10K Ohm | D302 (132) = TVS 440V |
| C200 (158) = 1 nf | T201 (124) = 1 mH |
| C201 (142) = 1.5 nf | T101 (51) = 0.6 mH |
| C202 (156) = 1.5 nf | |
| C210 (160) = 1.2 nf | L1 (118) = F32T8 |
| C211 (134) = 2.7 nf | L2 (120) = F32T8 |
| C212 (146) = 2.7 nf | CP1 (114) = LM324 |

Figure 5:
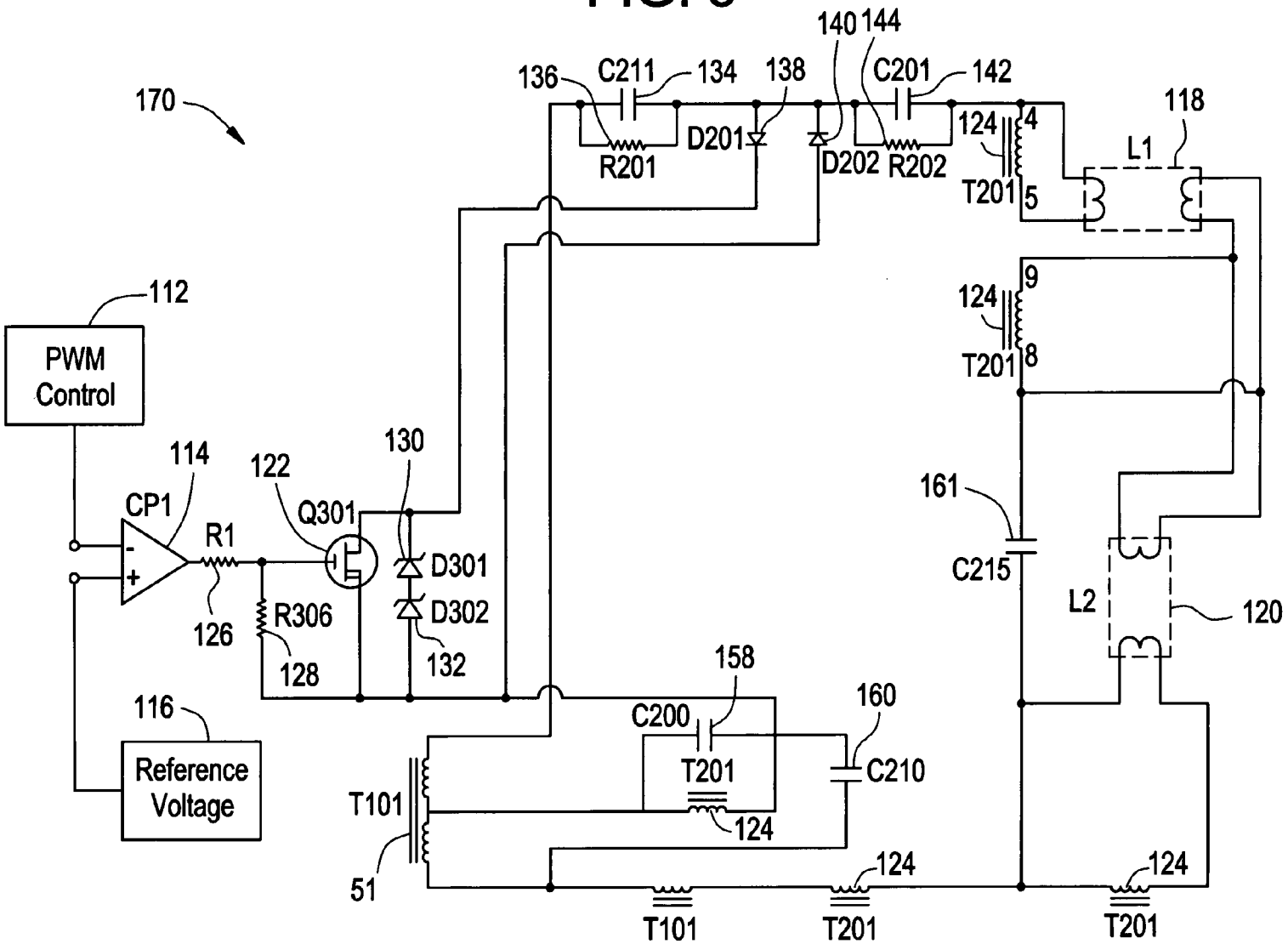
FIG. 5 is a schematic representation of a series lamp ballast circuit according to an exemplary embodiment of this disclosure.

With reference to FIG. 5, illustrated is a schematic representation of a series configured lamp circuit 170 according to one embodiment of this disclosure. This circuit is operatively connected to the inverter circuit illustrated in FIG. 3 via T101 51.

In one embodiment,

| | |
|---|---|
| R1 (126) = 100 Ohm | D202 (140) = SR1M |
| R201 (136) = 1M Ohm | D203 (150) = SR1M |
| R202 (144) = 1M ohm | D204 (152) = SR1M |
| R203 (148) = 1M ohm | D301 (130) = TVS 440V |
| R204 (154) = 1M ohm | D302 (132) = TVS 440V |
| R306 (128) = 10K ohm | T201 (124) = 1.3 mH |
| C200 (158) = 1 nf | T101 (51) = 0.9 |
| C201 (142) = 3.3 nf | |
| C210 (160) = 1.5 nf | L1 (118) = F32T8 |
| C211 (134) = 3.3 nf | L2 (120) = F32T8 |

-continued

| | |
|---|---|
| D201 (138) = SR1M | CP1 (114) = LM324 |
| C215 (161) = 470 pf | |

The invention has been described with reference to the preferred embodiments. Obviously, modifications and alterations will occur to others upon reading and understanding the preceding detailed description. It is intended that the invention be construed as including all such modifications and alterations.

What is claimed is:

1. A ballast lamp circuit comprising:

an inverter circuit configured to convert a dc waveform to a first ac current waveform for driving a first lamp; and a cathode heating circuit operatively connected to the inverter circuit and configured to generate a second ac waveform for heating the electrodes of the first lamp, the RMS value of the second ac waveform decreasing as the RMS value of the first ac current waveform increases, and the RMS value of the second ac waveform increasing as the RMS value of the first ac current waveform decreases, wherein the RMS value of the second ac waveform is controlled with pulse width modulation.

2. The ballast lamp circuit according to claim 1, wherein the minimum RMS value of the second waveform is a first predetermined value, the cathode heating circuit generating the minimum RMS value when the first ac waveform is greater than a second predetermined value.

3. The ballast lamp circuit according to claim 2, wherein the first predetermined value is less than or equal to approximately 4 V RMS and the second predetermined value is greater than or equal to approximately 75% of the rated current for driving a first lamp.

4. The ballast circuit according to claim 2, further comprising:

the inverter circuit configured to convert the dc waveform to a third ac waveform for driving a second lamp; and the cathode heating circuit configured to generate a fourth ac waveform for heating the electrodes of the second lamp.

5. The ballast circuit according to claim 4, further comprising:

a control circuit configured to operate the ballast circuit with two or more lamps operatively connected in parallel or two or more lamps operatively connected in series.

6. The ballast circuit according to claim 5, further comprising a control circuit output, wherein the control circuit output is operatively connected to one or more lamps.

7. The ballast circuit according to claim 2, wherein the RMS value of the first waveform is controlled using pulse width modulation.

8. The ballast circuit according to claim 2, wherein the RMS value of the first ac waveform and the RMS value of the second waveform is controlled using bi-frequency pulse width modulation.

9. The ballast circuit according to claim 8, wherein the pulse width modulation frequency is greater than or equal to 100 Hz, and less than or equal to 1 kHz.

10. The ballast circuit according to claim 2, further comprising:

a frequency modulator, the frequency modulator controlling the RMS value of the first ac current waveform, and the frequency modulator controlling the pulse width modulation of the second ac waveform.

11. The ballast circuit according to claim 2, further comprising:

a dimming signal input, the ballast circuit configured to control the RMS value of the first and second ac waveforms as a function of the dimming signal input.

12. The ballast lamp circuit according to claim 2, the RMS value of the first ac current waveform is inversely proportional to the RMS value of the second ac waveform, and the RMS value of the first ac current waveform is less than approximately the second predetermined value and the RMS value of the second ac waveform is greater than approximately the first predetermined value.

13. The ballast lamp circuit according to claim 2, wherein the first lamp is a fluorescent lamp.

14. The ballast lamp circuit according to claim 1, wherein the inverter circuit and cathode heating circuit are synchronized.

15. The ballast lamp circuit according to claim 1, wherein the RMS value of the second waveform is controlled using bi-level frequency modulation.

16. The ballast lamp circuit according to claim 7, wherein the inverter circuit comprises a current fed based inverter circuit.

17. The ballast lamp circuit according to claim 7, wherein the inverter circuit comprises a voltage fed based inverter circuit.

18. The ballast circuit according to claim 1, wherein the inverter circuit operates at a frequency approximately equal to or greater than 20 kHz, and approximately equal to or less than 30 MHz.

19. The ballast circuit according to claim 7, wherein the cathode heating circuit is pulse width modulated at a frequency approximately equal to or greater than 100 Hz, and approximately less than or equal to 1 kHz.

20. A ballast lamp circuit comprising:

a means for converting a dc waveform to one or more ac waveforms for driving, respectively, one or more lamps; and a means for generating one or more pulse width modulated ac waveforms for heating the electrodes of the one or more lamps, wherein the RMS value of the one or more ac waveforms for heating the electrodes decreases as the RMS value of the ac waveforms for driving the one or more lamps increases, and the RMS value of the one or more ac waveforms for heating the electrodes increases as the RMS value of the ac waveforms for driving one or more lamps decreases.

21. The ballast lamp circuit according to claim 20, further comprising:

a means for controlling the minimum RMS value of the ac waveform for heating the electrodes to a first predetermined value, the cathode heating circuit generating the minimum RMS value when the ac waveform for driving the one or more lamps is greater than a second predetermined value.

22. A ballast lamp circuit according to claim 21, further comprising:

a means for operating the ballast lamp circuit with two or more lamps operatively connected in parallel or two or more lamps operatively connected in series.

23. A method of operating a hot cathode lamp, comprising:

driving one or more lamps with a lamp current to produce a lamp lumen output, the lamp lumen output decreasing as the lamp current is decreased and increasing as the lamp current is increased; and supplying a pulse width modulated cathode heating voltage to the electrodes of the one or more lamps, the cathode heating voltage decreasing as the lamp current is decreased and increasing as the lamp current is increased, the cathode heating voltage limited to a minimum voltage when the lamp current is less than a predetermined value and the cathode heating voltage is at a minimum or zero when the lamp current is more than a predetermined value.

24. The method according to claim 23, wherein the one or more lamps are connected in parallel.

25. The method according to claim 23, wherein the one or more lamps are connected in series.

26. The method according to claim 23, wherein the lamp current and cathode heating voltage are controlled using frequency modulation.

27. The method according to claim 23 wherein the lamp current and cathode heating voltage are controlled using pulse width modulation.

28. The method according to claim 27, further comprising:

controlling the lamp current and cathode heating voltage with a bi-level switch, the lamp current increasing as the bi-level switch operates in one mode for an increasing time duration, the lamp current decreasing as the bi-level switch operates in a second mode for a decreasing time duration, the cathode heating voltage decreasing as the bi-level switch operates in the one mode for an increasing time duration and the cathode heating voltage increasing as the bi-level s witch operates in the second mode for a decreasing time duration.

29. The method according to claim 23, wherein the lamp current and cathode heating voltage are controlled using bi-level frequency modulation.

* * * * *